US008382431B1

(12) United States Patent
Liang

(10) Patent No.: US 8,382,431 B1
(45) Date of Patent: Feb. 26, 2013

(54) TURBINE ROTOR BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 832 days.

(21) Appl. No.: 12/562,009

(22) Filed: Sep. 17, 2009

(51) Int. Cl.
*F01D 5/18* (2006.01)

(52) U.S. Cl. ..... 416/1; 416/90 R; 416/97 R; 416/226; 416/241 R

(58) Field of Classification Search ..... 415/115, 415/116; 416/1, 90 R, 95, 96 A, 96 R, 97 A, 416/97 R, 226, 241
See application file for complete search history.

(56) References Cited

U.S. PATENT DOCUMENTS 6,955,525 B2 * 10/2005 Liang ..... 416/97 R
7,390,168 B2 * 6/2008 Liang ..... 416/97 R
2008/0008598 A1 * 1/2008 Liang ..... 416/97 R

* cited by examiner

*Primary Examiner* — Edward Look
*Assistant Examiner* — Jason Davis
(74) *Attorney, Agent, or Firm* — John Ryznic

(57) ABSTRACT

A turbine rotor blade an open cavity and a series of vortex chambers formed along the pressure and suction side walls to form a cooling air path from the leading edge, along the pressure side wall toward the trailing edge, and then from the trailing edge along the suction side wall to be discharged at the leading edge region on the suction side wall as film cooling air. The vortex chambers and feed slots connected adjacent vortex chambers are enclosed with a thin thermal skin to form a thin airfoil wall.

10 Claims, 3 Drawing Sheets

View B-B

TURBINE ROTOR BLADE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade.

2. Description of the Related Art Including Information Disclosed Under 37 CFR 1.97 and 1.98

A gas turbine engine includes a turbine with rotor blades and stator blades that are exposed to a hot gas flow in order to convert combustion energy into mechanical energy. The turbine efficiency, and therefore the engine efficiency, can be increased by passing a higher temperature gas flow through the turbine, referred to as the turbine inlet temperature. The highest turbine inlet temperature is limited to both the material properties of the airfoils (both blades and vanes have airfoils) and the amount of cooling that can be produced in these airfoils.

FIG. 1 shows a prior art turbine rotor blade of U.S. Pat. No. 5,702,232 issued to Moore on Dec. 30, 1997 and entitled COOLED AIRFOILS FOR A GAS TURBINE ENGINE. This blade uses near wall cooling in the airfoil mid-chord section that is constructed with radial flow channels plus resupply holes in conjunction with film discharge cooling holes. In this design, the spanwise and chordwise cooling air flow control due to airfoil external hot gas temperature and pressure variation is difficult to achieve. In addition, a single radial flow channel is not the best method of utilizing cooling air because this results in a low convective cooling effectiveness. Also, the dimension for the airfoil external wall has to meet the investment casting requirements.

BRIEF SUMMARY OF THE INVENTION

It is an object of the present invention to provide for a turbine rotor blade with a near wall vortex cooling design.

It is another object of the present invention to provide for a turbine rotor blade with a cooling circuit that can achieve a desired local metal temperature.

The above objective and more are achieved with the cooling circuit for a turbine rotor blade of the present invention in which the blade includes an open cavity formed between the pressure side wall and the suction side wall, and with multiple vortex chambers formed in the walls designed based on the airfoil gas side pressure distribution in both chordwise and spanwise directions. A parallel flow arrangement for the airfoil pressure side surface is designed which is inline with the airfoil external pressure profile. A counter flow arrangement for the airfoil suction side is used which is inline with the airfoil external pressure profile. Also, each individual vortex chamber can be designed based on the airfoil chordwise local external heat load to achieve a desired local metal temperature level. This is achieved by means of varying the tangential velocity and pressure level within the vortex chamber with different pressure ratio across the inter-link cooling feed slots. The multiple vortex tubes can be compartmentalized in the spanwise direction to trailing the gas side pressure profile and achieve the blade spanwise allowable design temperature requirement.

The interlinked vortex chambers provide for a long flow path for the coolant parallel to the chordwise direction of the gas path pressure and temperature profiles. In general, these vortex chambers create a high overall cooling effectiveness. The injection process for the cooling air repeats throughout the entire inter-linked vortex chambers and then exit out the airfoil trailing edge through multiple small slots and suction side curved diffusion film cooling slots. Trip strips in the radial direction or micro pin fins can be incorporated into the inner walls of the vortex chambers to further augment the internal heat transfer performance.

DETAILED DESCRIPTION OF THE INVENTION

Figure 1:
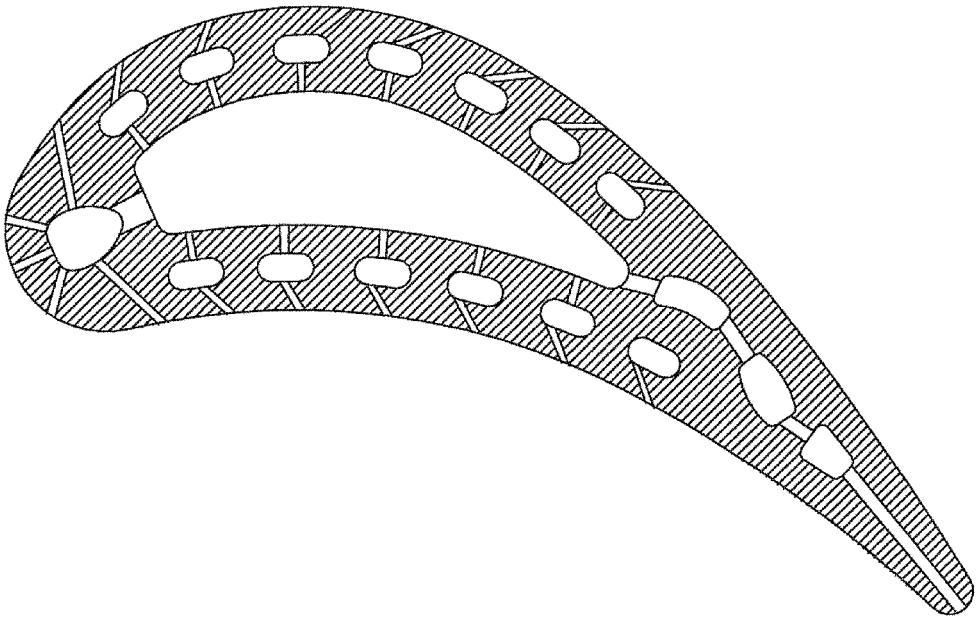
Fig 1 Prior Art
FIG. 1 shows a turbine rotor blade of the prior art with radial cooling channels formed within the airfoil walls.
Figure 2:
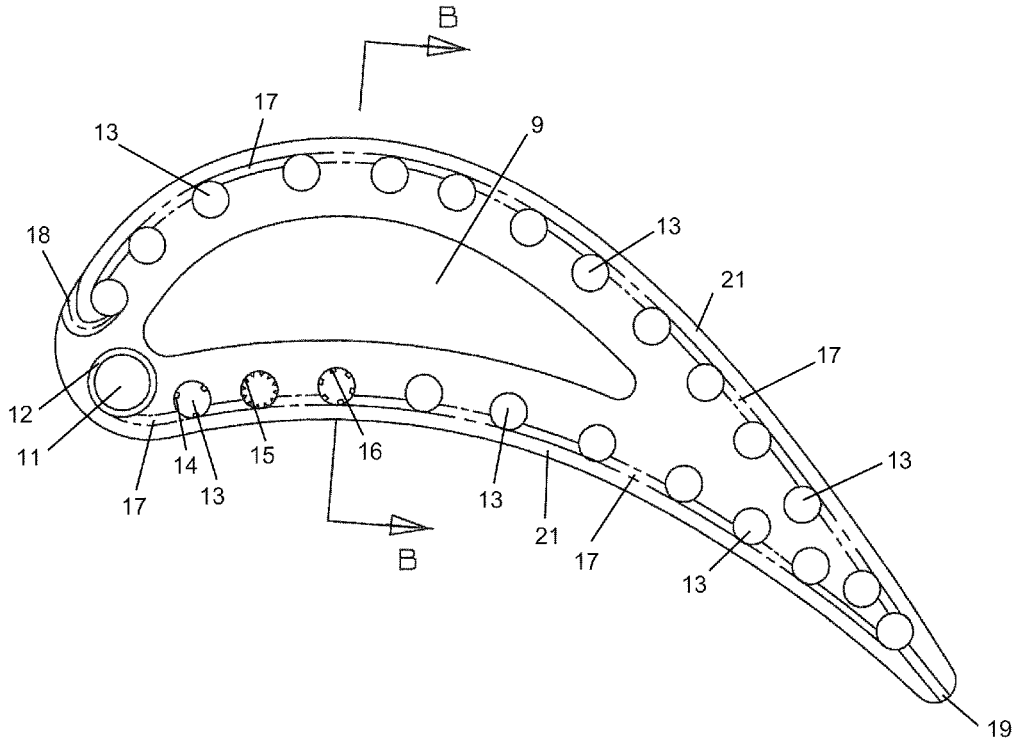
FIG. 2 shows a cross section cut-away view of the blade with the vortex chambers of the present invention.
Figure 3:
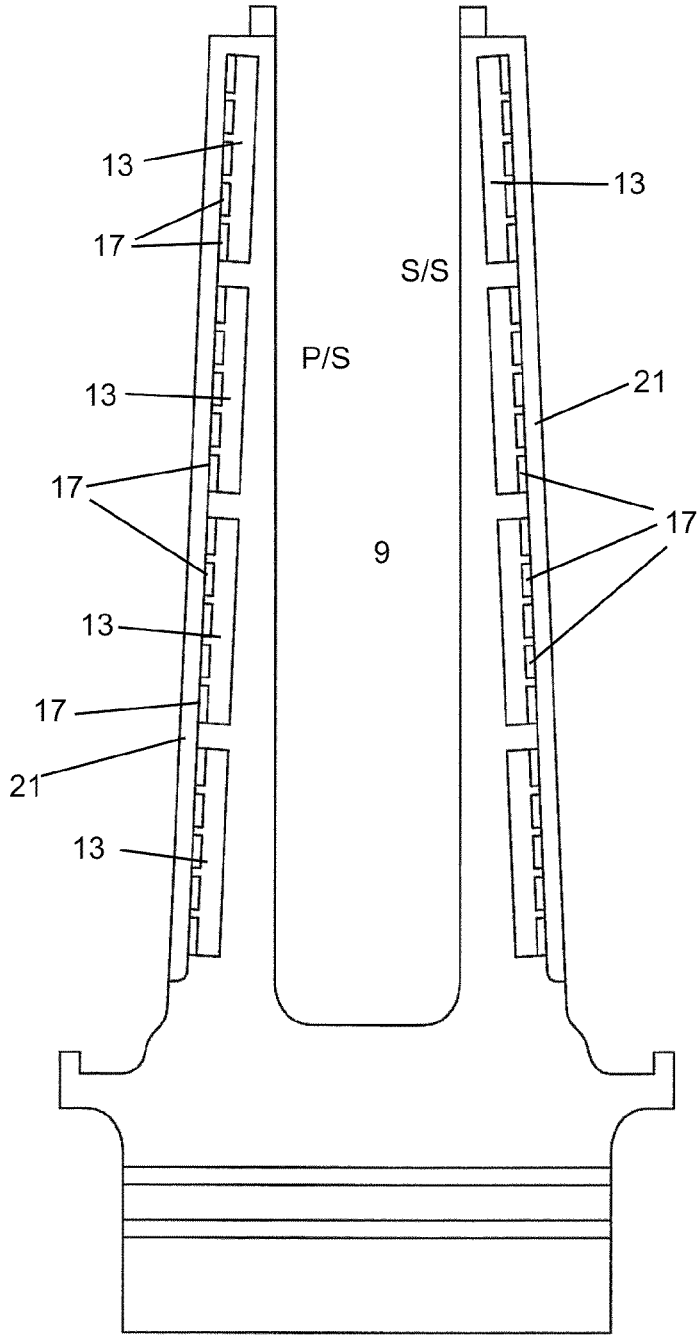
FIG. 3 shows a cross section view of the blade of the present invention.

The turbine blade of the present invention is shown in FIGS. 2 and 3. In FIG. 2, the blade includes an airfoil with an open cavity 9 formed between the walls that are open on the blade tip as seen in FIG. 3. However, the vortex chambers can be used in a blade without an open top. As seen in FIG. 2, the blade includes a leading edge cooling supply radial channel 11 with a number full circular trip strips 12 extending along the channel. Extending along the pressure side wall from the radial supply channel 11 is a number of vortex chambers 13 having a circular cross section shape formed within the wall. The vortex chambers each include spanwise extending trip strips 14 or roughened surfaces 15 or micro pin fins 16 to promote heat transfer from the hot metal to the cooling air. Connecting the adjacent vortex chambers 13 together are interlinked feed slots 17.

The vortex chambers 13 extend along the pressure side wall from the radial supply channel to the trailing edge region as far as the wall thickness will allow. The P/S vortex chambers are then connected to a row of vortex chambers formed on the suction side wall and ending adjacent to the leading edge where the radial supply channel 11 is located. The last vortex chamber—in the series—on the suction side wall is connected to a curved diffusion slot 18. Because of the decreasing thickness of the trailing edge region, the vortex chambers 13 alternate from P/S to S/S so that the series flow pattern remains along the T/E. The vortex chamber 13 located closest to the trailing edge is connected to a row of T/E exit slots 19. The vortex cooling air flow is from the radial supply channel, along the series of vortex chambers in the P/S wall, and then along the vortex chambers in the S/S wall toward the leading edge, and then discharged out the S/S curved diffusion slots. Some of the cooling air is discharged out the row of exit slots 19 in the T/E.

FIG. 3 shows another view of the vortex chamber cooling circuit of the present invention. Each vortex chamber is formed of a number of vortex tubes stacked in a radial or spanwise direction as seen in FIG. 3. This is also referred to as multiple compartment vortex tubes in the spanwise direction. However, each vortex chamber can be just one long vortex tube without compartments. In this embodiment, the vortex chamber 13 is formed with four vortex tubes. Each vortex tube is connected to an adjacent vortex tube through a number of feed slots 17. A thin airfoil wall 21 is bonded to the spar over the vortex tubes 13 and the feed slots 17 to enclose each. In the embodiment in which the vortex chambers are compartments with vortex tubes separated by ribs, this design cannot be cast for an industrial gas turbine engine blade because the ceramic core pieces cannot be held together. Thus, the vortex tubes and feed slots can be cast and then machined into their final shape. Then, a thin thermal skin (thin airfoil wall) 21 is bonded (using a transient liquid phase bonding process) to the spar to enclose the vortex chambers and the feed slots. The thin thermal skin allows for better heat transfer through the wall than would a thicker cast airfoil wall than is common in the industrial gas turbine airfoils. Thin walls cannot be cast using the present day investment casting process.

In operation, the cooling air is supplied through the airfoil leading edge radial supply channel in which the external heat load is the highest on the airfoil. The cooling air is then injected through the cooling feed slots and into the vortex chamber forming a vortex flow in the first P/S vortex chamber. The cooling air is then injected into the series of vortex chambers through the interlinked feed slots to form the cooling flow circuit for the entire airfoil P/S wall. The cooling air in the last vortex chamber closest to the T/E passes some of the cooling air through the row of T/E exit slots with the remaining cooling air then flowing through a series of vortex chambers located in the S/S wall also through a series of interlinked feed slots to provide cooling along the entire S/S wall. The last vortex chamber along the S/S wall is then discharged into the curved diffusion slots 18. The trip strips or pin fins care used to enhance the heat transfer effect from the hot metal to the cooling air flow. The vortex flow cooling chambers will generate a high coolant flow turbulence level and yield a higher internal convection cooling effectiveness than the prior art single pass radial holes.

I claim the following:

1. A turbine rotor blade comprising:

an airfoil with a leading edge and a trailing edge and a pressure side wall and a suction side wall both extending between the leading edge and the trailing edge;

an open cavity formed between the edges and walls;

a radial cooling supply channel formed in a leading edge of the airfoil and extending from a root to a blade tip;

a row of vortex chambers formed within the pressure side wall and extending from adjacent to the radial cooling supply channel to the trailing edge region;

a row of vortex chambers formed within the suction side wall and extending from the trailing edge region to adjacent to the radial cooling supply channel;

a plurality of feed slots to connect each of the vortex chambers from the radial cooling supply channel along the pressure side wall and along the suction side wall;

a row of trailing edge exit slots connected to the vortex chamber located nearest to the trailing edge; and, a row of suction side wall diffusion slots connected to the last vortex chamber on the suction side wall in the series to discharge cooling air.

2. The turbine rotor blade of claim 1, and further comprising:

some of the vortex chambers are formed with compartments of vortex tubes separated from one another.

3. The turbine rotor blade of claim 1, and further comprising:

each vortex chamber includes said row of feed slots extending a length of the vortex chamber.

4. The turbine rotor blade of claim 1, and further comprising:

the vortex chambers in the trailing edge region alternate from pressure side to suction side due to a thin spacing between the walls.

5. The turbine rotor blade of claim 1, and further comprising:

the feed slots and the vortex chambers open onto an outer surface of a main spar that forms a general shape of the airfoil; and, a thin thermal skin is bonded to the main spar to enclose the vortex chambers and the feed slots, the thin thermal skin forming the airfoil surface of the blade.

6. The turbine rotor blade of claim 1, and further comprising:

the suction side wall diffusion slots are curved diffusion slots that curve in a direction of hot gas flow over the suction side wall.

7. The turbine rotor blade of claim 1, and further comprising:

the vortex chambers form a closed cooling air path from the leading edge radial cooling supply channel to the row of suction side wall diffusion slots, such that the cooling air flows along the pressure side wall toward the trailing edge and then flows along the suction side wall toward the leading edge with a row of exit slots connected to the closed cooling air path in the trailing edge region.

8. A process for providing near wall cooling for a turbine rotor blade, comprising the steps of:

passing cooling air along a leading edge of the blade;

passing the cooling air along the pressure side in a series of vortex flows from the leading edge region to a trailing edge region along the pressure side wall;

discharging a portion of the cooling air through the trailing edge to provide cooling for the trailing edge region;

passing the remaining cooling air along a series of vortex chambers along the suction side wall from the trailing edge region to the leading edge region; and, discharging the remaining cooling air as film cooling air onto the suction side wall in the leading edge region.

9. The process for providing near wall cooling for a turbine rotor blade of claim 8, and further comprising the step of:

passing the cooling air adjacent vortex flows along a backside surface of the airfoil to produce near wall cooling.

10. The process for providing near wall cooling for a turbine rotor blade of claim 8, and further comprising the step of:

passing the cooling air through a closed path with the exception of the trailing edge cooling.

* * * * *